US006112932A

United States Patent [19]

Holdren

[11] Patent Number: 6,112,932

[45] Date of Patent: Sep. 5, 2000

[54] BEVERAGE CAN WITH FLOW ENHANCING SIDEWALL STRUCTURE

[76] Inventor: Ronald E. Holdren, 22041 127th St. E., Sumner, Wash. 98390

[21] Appl. No.: 09/378,379

[22] Filed: Aug. 20, 1999

[51] Int. Cl.[7] ..... B65D 1/16

[52] U.S. Cl. ..... 220/269; 220/669; 220/906; 222/564

[58] Field of Search ..... 220/269, 669, 220/703, 906; 222/564

[56] References Cited

U.S. PATENT DOCUMENTS

| | | | |
|---|---|---|---|
| D. 63,657 | 12/1923 | Root . | |
| D. 275,834 | 10/1984 | Slade . | |
| D. 356,501 | 3/1995 | Kornick et al. . | |
| D. 357,414 | 4/1995 | Kornick et al. . | |
| D. 392,566 | 3/1998 | Vahjen et al. . | |
| D. 393,205 | 4/1998 | Jansen . | |
| D. 399,429 | 10/1998 | Ramsey . | |
| D. 403,964 | 1/1999 | Jansen . | |
| D. 404,255 | 1/1999 | Asberg . | |
| 1,575,870 | 3/1926 | Sehlbach . | |
| 1,770,093 | 7/1930 | West . | |
| 2,186,940 | 1/1940 | Sullivan | 220/906 X |
| 3,904,069 | 9/1975 | Toukmanian . | |
| 4,316,551 | 2/1982 | Belokin, Jr. . | |
| 4,417,667 | 11/1983 | Roth et al. . | |
| 4,586,625 | 5/1986 | Garrett . | |
| 4,762,229 | 8/1988 | Wickre | 220/906 X |
| 4,913,305 | 4/1990 | Hanafusa et al. . | |
| 5,071,042 | 12/1991 | Esposito . | |
| 5,178,289 | 1/1993 | Krishnakumar et al. . | |
| 5,301,830 | 4/1994 | Muller | 220/906 X |
| 5,346,095 | 9/1994 | Deal . | |
| 5,405,039 | 4/1995 | Komura . | |
| 5,407,086 | 4/1995 | Ota et al. . | |
| 5,586,681 | 12/1996 | Policappelli . | |
| 5,645,190 | 7/1997 | Goldberg . | |
| 5,695,085 | 12/1997 | Hadener . | |
| 5,711,448 | 1/1998 | Clarke, III . | |
| 5,776,270 | 7/1998 | Biondich . | |
| 5,813,811 | 9/1998 | Saunders . | |
| 5,868,272 | 2/1999 | Deal | 220/906 X |
| 5,899,355 | 5/1999 | Claydon | 220/906 X |
| 6,015,060 | 1/2000 | Rightenour et al. | 220/906 X |

*Primary Examiner*—Nathan J. Newhouse
*Attorney, Agent, or Firm*—R. Reams Goodloe, Jr.

[57] ABSTRACT

A beverage container with flow enhancing sidewall structure. The container is preferably provided in thin-walled aluminum for containment of carbonated or other beverages such as beer or carbonated soda. The container has a liquid outlet, and adjacent the liquid outlet, but in the substantially cylindrical sidewalls, a generally nose-shaped inwardly indented liquid flow enhancing structure is provided. The flow enhancing structure is provided with a generally reducing cross-sectional area when progressively examined in transverse cross-sectional area toward the liquid outlet end of the cylindrical sidewall. The generally nose-shaped structure may be offset from the centerline of the liquid outlet to further enhance liquid outflow. Although in a preferred embodiment the nose-shaped structure is substantially pyramidal in shape, the structure may alternately be provided as a section of an oblique circular cone, or other flow enhancing shape. Use of such a structure enables a user to locate the container outlet by use of tactile sense alone, such as by use of a thumb. Also, because the flow enhancing structure is inwardly indented, the beverage can is rollable for easy handling during manufacture and distribution.

20 Claims, 5 Drawing Sheets

BEVERAGE CAN WITH FLOW ENHANCING SIDEWALL STRUCTURE

TECHNICAL FIELD

This invention is directed to the field of beverage cans. More particularly, the invention is directed to wall designs for enhancement of liquid flow from beverage cans.

BACKGROUND

Cans have long been utilized for packaging colas and other carbonated drinks, for beer, water, fruit juices, and for a variety of other beverages. A wide variety of beverage can structures have been known and utilized as appropriate for particular drink applications. And, although most beverage cans have historically been constructed with smooth, relatively cylindrical sidewalls, a variety of alternate can structures have been developed.

However, a common problem encountered in beverage can structures which are known to me is that the cans leave a few "last drops" when the cans are emptied, thus always leave a few residual drops for spillage when the user engages in recycling of the cans. Additionally, a certain amount of splash occurs if the can is opened too quickly. Also, it is often rather difficult to achieve a "smooth" outlet flow from beverage cans, thus resulting in excessive foaming and head formation when pouring beer from such a can into a glass, for example. In general, the most commonly encountered openings in beverage cans, specifically a small elliptical opening provided when a tongue shaped tab is removed or popped inward and secured in the can, does not provide for a smooth flow of liquid from the can. Typically, such openings result in restricted outward flow, as outbound carbon dioxide competes with inbound air in the available opening space. Thus, smoothing the liquid flow, and thus decreasing carbon dioxide release by decreasing turbulent flow, would assist in flow of liquid from a beverage can. And, even though wide mouth type cans have enhanced drinkability to some limited degree, I have found such cans less than satisfactory in providing smooth, continuous delivery of a beverage to the mouth of the user. Additionally, if the user is not extremely careful, such wided mouth cans can cause a mess when opened.

Another problem inherent in many prior art beverage can designs is that the alignment of the liquid outlet with the drinker's mouth, or a desired glass, cannot be accomplished by touch alone. I am aware of one attempt to provide a can which can be aligned by touch, which can be seen in U.S. Pat. No. 5,346,095, issued Sep. 13, 1994 to Richard Deal for a BEVERAGE CAN. However, his design diminishes the fluid capacity of a given height of can to an undesirable degree, since he provides flattened opposing surfaces on the can sidewalls, thus transforming cylindrical can sidewalls into an oval shape. And, it does not solve the problem which I have addressed with the present invention, namely, providing a can for the quick and efficient orientation with the users hand, without visual clues, while maximizing the fluid capacity of the container.

Thus, there remains a continuing, unmet need for a beverage can which minimizes turbulence of exiting liquid, both when opened and during the process of drinking the beverage, thus promoting drinkability, and which provides quick and easy orientation of the hands with respect to the liquid outlet. Further, there remains a continuing, unmet need for a beverage can which minimizes residual liquids in the can after the user has finished drinking.

OBJECTS, ADVANTAGES, AND NOVEL FEATURES

Accordingly, the primary objective of my invention is to provide a beverage can in which the drinkability of liquids in the can is significantly improved.

Another objective of my invention is to provide a beverage can in which the openability of the can is significantly improved.

Another important objective is to provide a convenient device and structure which enables the user to orient his or her hands with respect to the liquid outlet of the can, without the need for visual clues.

A related and important objective is to provide a structure which enhances the removal of liquids from a beverage can during normal use, thus minimizing residual liquids in the can after the user has completed drinking.

Another important and primary objective is to provide a structure and design in a beverage can in which the can may be conventionally packaged, stored, shipped, and distributed, in that the can will roll as a cylinder, rather than have a "flat-spot" which resists rolling action.

Finally, an important objective is to provide a liquid removal promoting structure in a beverage can which can be conveniently and easily formed during normal can manufacturing processes, so that manufacturing costs are minimized.

SUMMARY

I have now invented a beverage container, preferably embodied in an aluminum can, in which a flow dividing and liquid flow enhancing structure is provided on the container sidewalls, oriented with (or adjacent to), and longitudinally near, the liquid outlet of the beverage can. The liquid flow enhancing structure is a generally nose-shaped indentation in the normally cylindrically shaped can sidewall, with a long, central ridge structure running outwardly and downwardly toward the liquid outlet, when viewed in cross-section with the can in a liquid dispensing configuration.

In various embodiments, the generally nose-shaped structure may be of smooth, rounded, nose-shaped configuration, or, more preferably, may be provided in a generally pyramidal configuration. Alternately, the generally nose-shaped structure may be provided with an arrowhead configuration having an arcuate base. And, in yet another configuration, the generally nose-shaped structure may be provided in a partial conical configuration, ideally as a section of an oblique circular cone, with the vertex of the cone section located at the top of the container sidewall, near the liquid outlet of the can, and with the base of the cone section located in the lower reaches of the generally nose-shaped structure, so as to form an indentation in the can.

For orientation of the liquid outlet, the generally nose-shaped indentation in the beverage container may be located in-line with the liquid outlet, so that the container can be oriented by touch, without the need for visual clues. Alternately, the generally nose-shaped indentation may be located slightly off-center from the liquid outlet, yet still adaptable for tactile sensation by the user, to orient the liquid outlet of the container.

DETAILED DESCRIPTION

Figure 1:
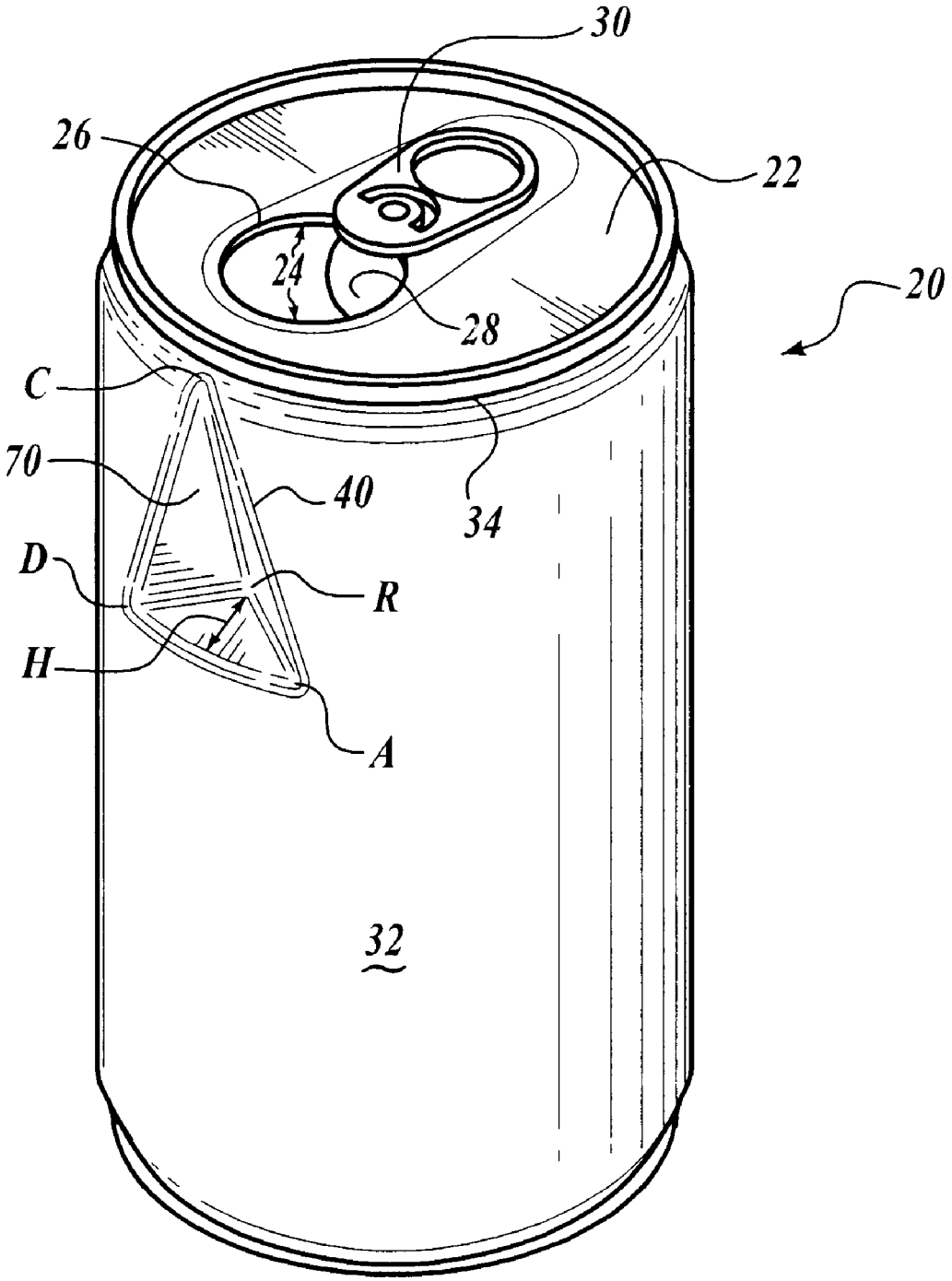
FIG. 1 is a perspective view of my flow enhancing beverage container, showing a generally pyramidal indentation in a cylindrical sidewall of the container, where the indentation is located near and oriented in alignment with the liquid outlet in the top of the container.

Attention is directed to FIG. 1, where a perspective view of my unique liquid flow enhancing beverage container 20 is illustrated. The container which I have developed is here illustrated as an aluminum can, but it is to be understood that other materials of construction, such as steel, plastic, or other non-metallic substances may advantageously utilize the liquid flow enhancing structures described herein. As illustrated, container 20 has a top 22 with a liquid outlet 24 defined by an interior sidewall 26 which is exposed after snap top 28 has been opened by inward displacement of snap top 28 via use of tab 30. The container 20 has a generally cylindrically shaped sidewall 32 which is sealingly affixed to top 22. Aligned with liquid outlet 24 and located at or near the upper end 34 of the cylindrically shaped sidewall 32 is a generally nose-shaped indentation 40. As illustrated in this FIG. 1, the generally nose-shaped indentation 40 is preferably shaped substantially as a pyramid, having a radially inward indentation height H, a base of dimension A-D-C with a slightly curved lower end A-D along the cylindrical sidewall 32, and with slightly curved edges A-C and D-C converging at point C, here shown as located in-line with the center-line of liquid outlet 24. The inward-most point R of the pyramid defines the peak of the noseline or ridgeline R-C of the nose-shaped indentation structure 40. Thus, inwardly protruding surfaces A-D-R, A-R-C, and D-R-C define the inwardly protruding generally pyramidal structure of inwardly height H. While the aforementioned surface may be varied somewhat and still achieve the benefits of my invention as set forth herein, I prefer to utilize a generally pyramidal indentation structure 40 wherein the height H is about three eighths of an inch (⅜"), and angle R-C-A, and the angle R-C-D, are each up to about 45 degrees. However, I also prefer that the overall dimension R-C is up to about one-half of an inch (½"), and that the overall dimension A-D be from about ¾ to about 1 inch. Nevertheless, these are only examples of suitable dimensions, and such dimensions are not to be construed as being limited thereto, as both lesser or greater dimensions can be utilized, so long as the end result still provides liquid flow enhancement when emptying the beverage can 20. For example, dimensions down to as small as about 25% of the just described size will, in many cases, provide the required features and yield the desired results. Also, as more clearly seen in FIGS. 2 and 3, preferably the exterior edges A-D, D-C, and C-A of the pyramidal indentation 40 are radiused 50 or otherwise smoothed out. Likewise, ridgeline R-C is also radiused 50 or otherwise smoothed out, so as to provide a smoothly curved surface over which the liquid 60 contents of container 20 flow. For best results, the generally nose-shaped inward indentation 40, when viewed in transverse cross-sectional profile (i.e., normal to cylindrical sidewall 32), preferably has a transverse cross-sectional profile of reducing cross-sectional area as such profile is examined progressively from peak R toward the liquid outlet 24. Also, it is important, with respect to handling containers 20 during beverage manufacture and distribution, that with the generally nose-shaped inwardly protruding structures 40 provided, that containers 20 are still rollable along a suitable surfaces, similar to conventional prior art aluminum cans.

Figure 2:
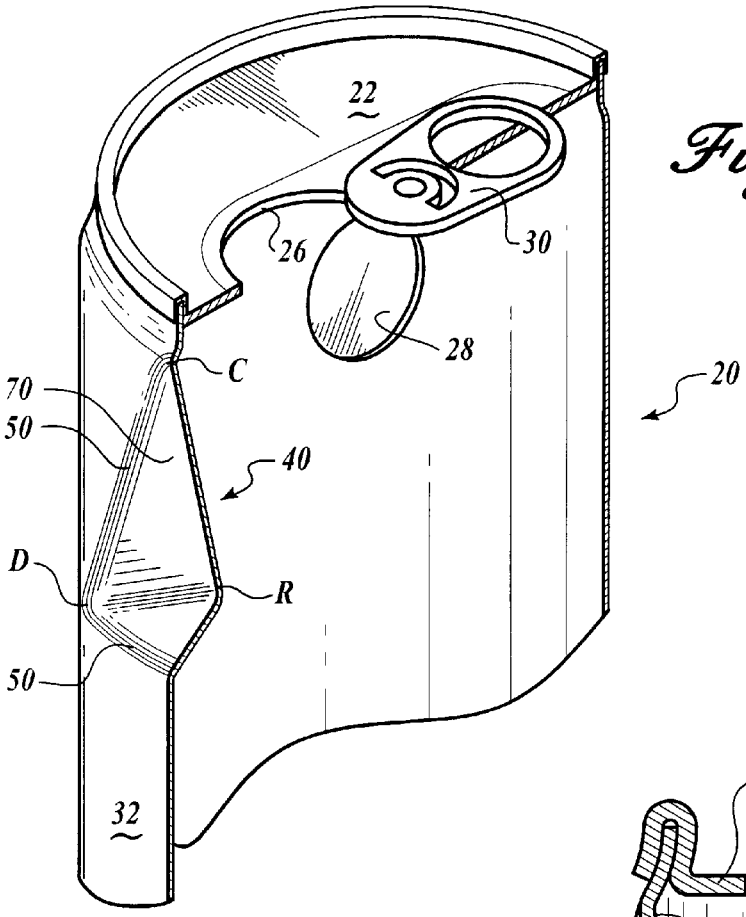
FIG. 2 is a partial cross-sectional perspective view of the beverage container just shown in FIG. 1 above, now showing the generally pyramidal indentation cut along its centerline, revealing the generally nose-shaped inward indentation structure in the container sidewall.
Figure 3:
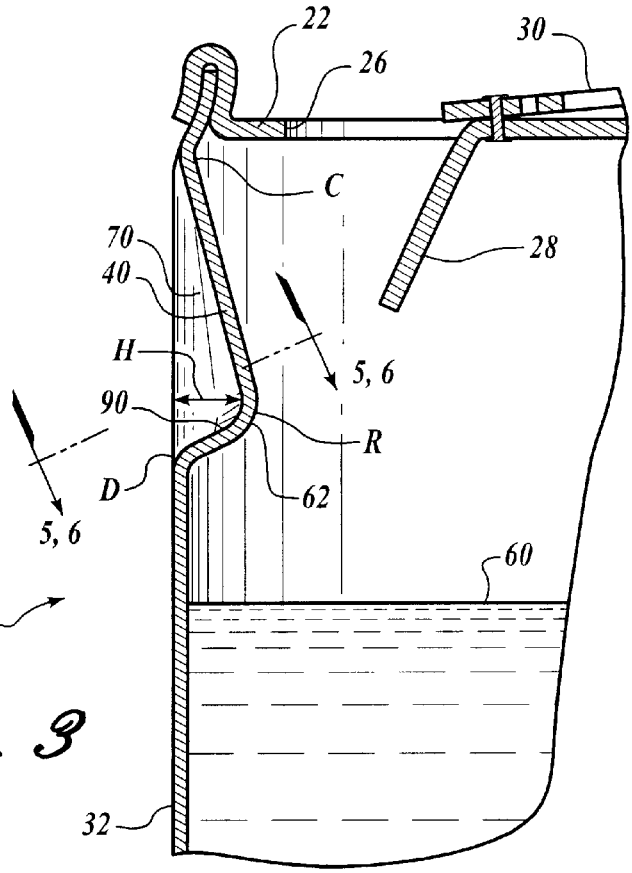
FIG. 3 is a vertical cross-sectional view of a beverage container, showing a container sidewall with a generally nose-shaped indentation near the liquid outlet.

Turning now to FIGS. 2 and 3, the generally nose-shaped inwardly protruding flow enhancing structure 40 can be clearly seen. The nose-shaped flow enhancing structure is preferably integrally formed with, and is an unobtrusive part of, the generally cylindrical sidewall 32. In the partial vertical cross-sectional view shown in FIG. 3, a smoothly curved can wall 62 is shown at peak R, and the integrally formed structure 40 is clearly evident. Also, the inwardly sloping plane D-R-C with outer surface 70 of the generally pyramidal shaped structure 40 is evident.

Figure 4:
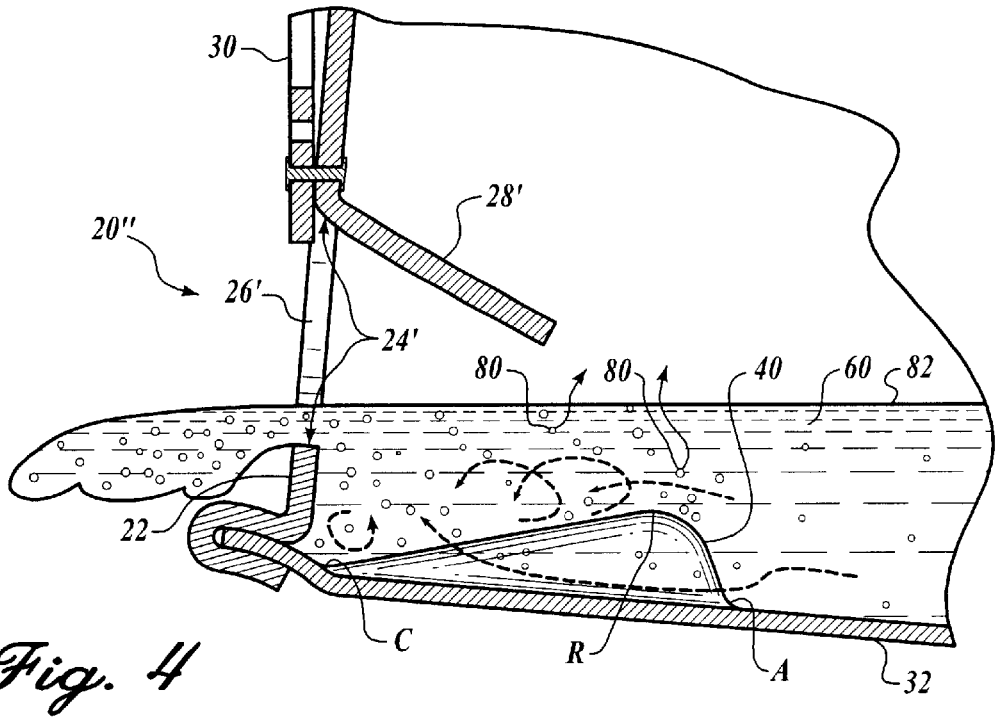
FIG. 4 is a partial cross-sectional view of a beverage container in a liquid dispensing position, in a near horizontal orientation, showing the generally nose-shaped indentation in the sidewall as it smoothes liquid flow toward the liquid outlet.
Figure 10:
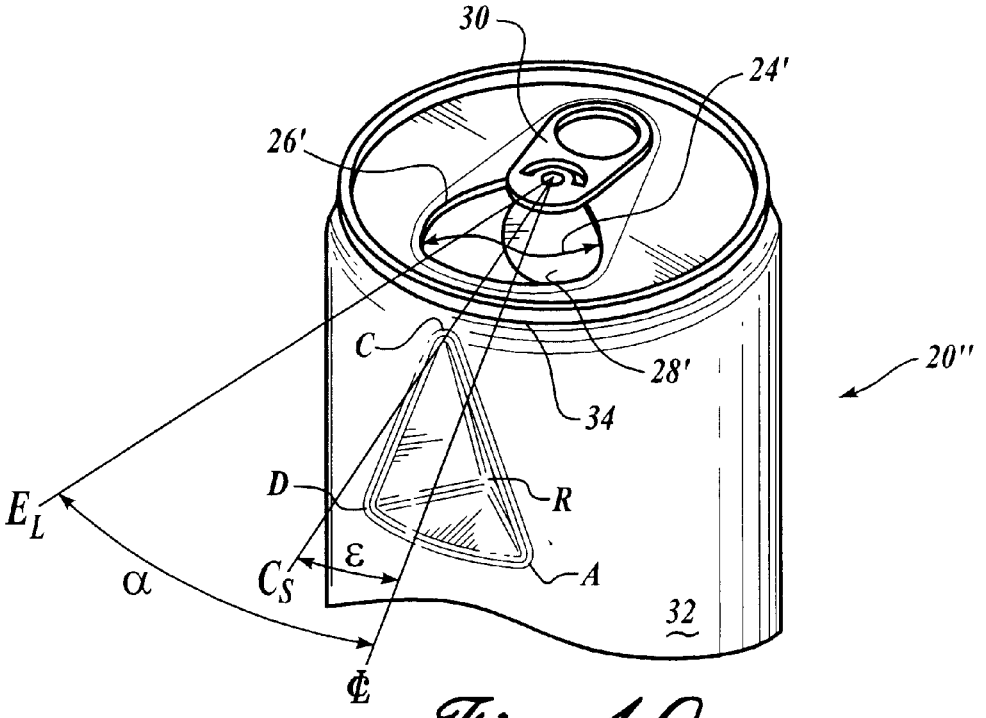
FIG. 10 is yet another embodiment of my liquid flow enhancing beverage can, showing a generally pyramidal indentation located in an angularly off-set location with respect to the liquid outlet, in a wide-mouth type liquid outlet can.

In FIGS. 4 and 10, one preferred embodiment is shown wherein container 20" has a widemouth liquid outlet 24' defined by sidewall 26', having matching snap top 28'. The centerline $C_S$ of the generally nose-shaped structure 40 is offset clockwise (when viewed from the top) from the centerline $C_L$ of the liquid outlet 24' by an angle sigma ($\Sigma$) . Preferably, the centerline $C_S$ is offset at least one third of the total angle alpha ($\alpha$) between the centerline $C_L$ of the liquid outlet 24' and the edgeline $E_L$ of the liquid outlet 24'. In one preferred embodiment, the centerline $C_s$ is offset to the location of the edgeline $E_L$ so that the centerline $C_S$ is co-located with the edgeline $E_L$, i.e. is offset from the centerline $C_L$ of the liquid outlet 24' by an angle alpha ($\alpha$). In the latter case, the view set forth in FIG. 4 is provided, in that the generally nose-shaped structure 40 is seen integrally provided and indented into the generally cylindrical sidewall 32 of container 20, but it is off-set from the centerline of the liquid outlet 24', through which the section shown in FIG. 4 is provided. In this FIG. 4, it can be appreciated that the structure 40 reduces the volume of liquid 60 remaining when container 20" is emptied. Also, it can be appreciated that as liquid 60 passes by the generally nose-shaped structure 40, carbon dioxide gas 80 which is present in bubble form is urged toward the surface 82 of the liquid 60, so as to be liberated within the container 20, rather than causing foam external to the container 20.

Figure 9:
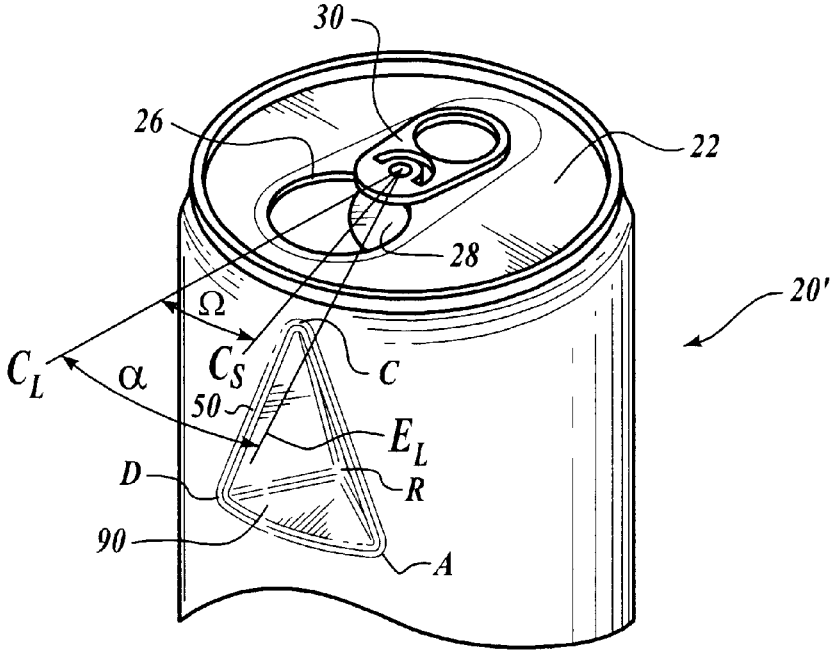
FIG. 9 is another embodiment of my liquid flow enhancing beverage can, showing a generally pyramidal indentation located in an angularly off-set location with respect to the liquid outlet.

Similar to a clockwise offset, as indicated in container 20' shown in FIG. 9, the structure 40 can be offset counter-clockwise by an angle omega ($\Omega$), which angle is preferably at least one third of the angular distance between the centerline $C_L$ and the edgeline $E_L$ of the liquid outlet 24.

More preferably, the centerline $C_L$ of the inwardly protruding structure 40 is located at the edgeline $E_L$ of the liquid outlet 24. However, the ideal location for the inwardly protruding structure 40 may vary somewhat based on container 20' size and shape.

Figure 5:
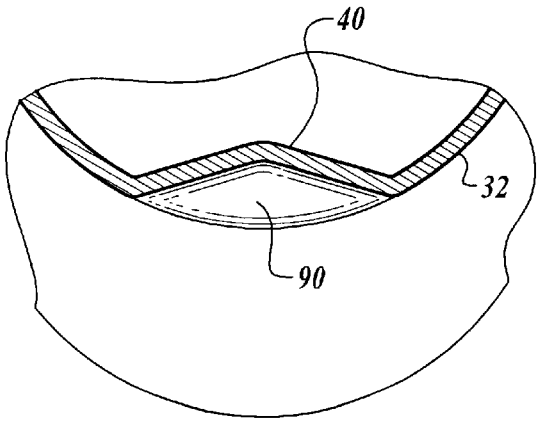
FIG. 5 is a cross-sectional view, taken across section 5—5 of FIG. 3, showing a generally pyramidal nose-shaped indentation in the generally cylindrical sidewall.
Figure 6:
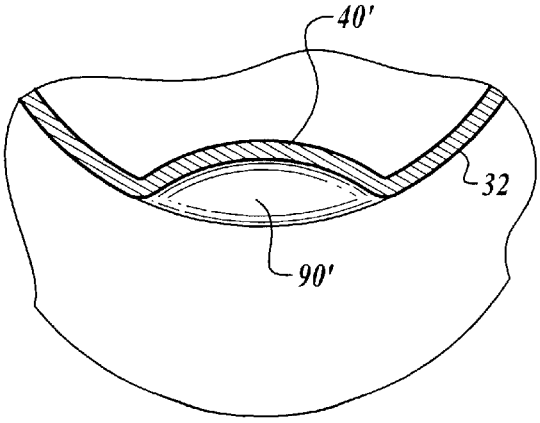
FIG. 6 is a cross-sectional view, taken across section 6—6 of FIG. 3, showing a partial cone-shaped configuration of the nose-shaped indentation in the generally cylindrical sidewall.
Figure 7:
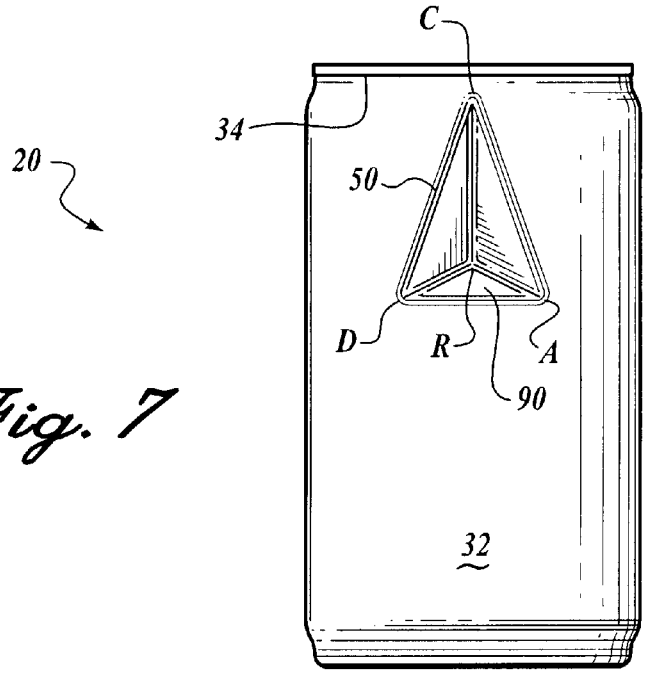
FIG. 7 is a side elevation view of my liquid flow enhancing beverage can, showing a generally pyramidal indentation located near the liquid outlet.

Although my novel beverage can 20 has been described with respect to use of a generally pyramidal nose-shaped structure 40, it should be understood that alternate structures are feasible, as in part illustrated by the comparison of FIGS. 5 and 6. In FIG. 5, the cross-section 5—5 of FIG. 3 illustrates the above detailed pyramidal structure 40. However, in FIG. 6, the cross-section 6—6 of FIG. 3 illustrates the use of an alternate nose-shaped structure 40', which is conically shaped, in cross-section and provided with an oblique circular cone base 90' with resulting shape similar in plane (but not in edge profile) as that illustrated for the base 90 as detailed with respect to the pyramidal shaped structures shown, for example, in FIG. 3. Also, a generally arrowhead shaped inwardly protruding structure 40 is of the same general appearance, although a slightly more curved base 90' may be provided.

Figure 8:
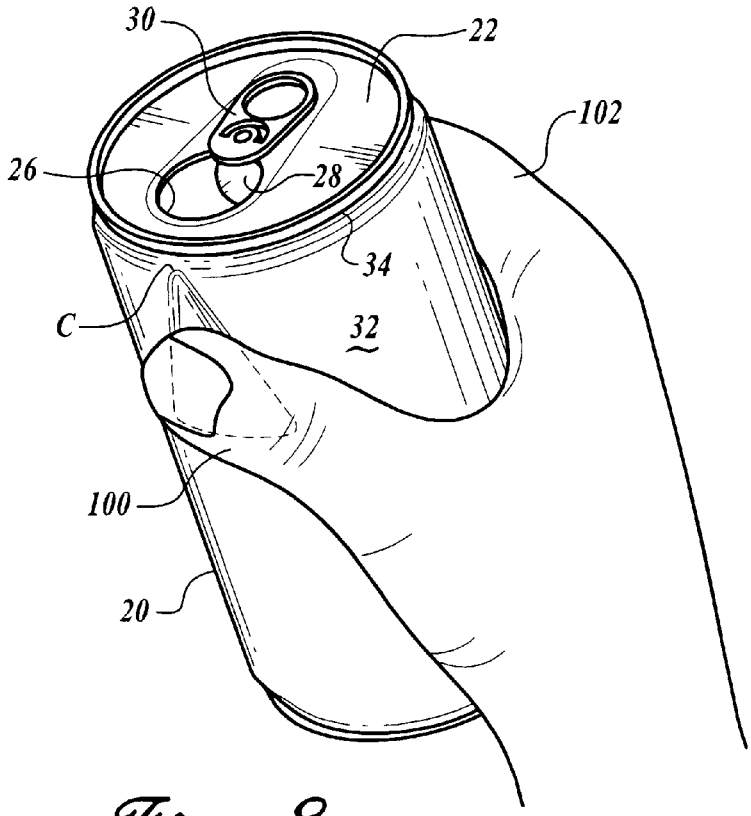
FIG. 8 is a perspective view of my liquid flow enhancing beverage can, illustrating the orientation of the indentation in line with the liquid outlet, so that the user can orient the liquid outlet by tactile sense alone.

As illustrated in FIG. 8, it is an advantage of my design for beverage container 20 that the intended structure 40 provides a user with the ability to use tactile sense alone, such as achieved by use of thumb 100, to find the structure 40 that is either co-located along the centerline of the liquid outlet 24, or is located adjacent thereto as described herein, so that the user can pick up container 20 and drink liquid 60 from the container 20 without the necessity to visually check for the location of the liquid outlet 24. Then, a user can grip container 20 between thumb 100 and fingers 102 while drinking or pouring, and have the ability to properly hold the container 20 with respect to liquid 60 leaving the container 20.

In the preparation and manufacture of beverage cans according to the present invention, it is to be understood that a variety of variations are feasible. For example, in beverage cans of suitable strength and wall thickness, a user can form an adequately shaped indentation prior to opening the can, in some cases. In other cases, where the internal pressure prevents indentation prior to opening, the desired indentation can be fully shaped after opening. Ideally, since the drinkability is not maximized unless the full indentation is achieved, the desired indentation shape is placed in the can before the can reaches the user or consumer. In this regard, the can may be formed, before filling, with the desired indentation shape. Alternately, the desired shape can be rolled into a can after sealing the beverage inside the can. In such cases, the rolling action decreases the vapor space remaining in the can, thus reducing contact area between the beverage and residual gas. In those cases where the composition of gases is a factor, the desired indentation reduces the detrimental effects of residual gases on the taste and quality of the beverage.

It is to be appreciated that my unique beverage containers, especially when implemented in strong, lightweight aluminum cans, is an appreciable improvement in the art of beverage container construction. My novel container addresses the problem of liquid removal from cans with a minimum of impediment to liquid flow, and with a minimum of foam formation, to provide a significantly improved beverage can. Although only a few exemplary embodiments of this invention have been described in detail, it will be readily apparent to those skilled in the art that my beverage container structure may be modified from those embodiments provided herein, without materially departing from the novel teachings and advantages provided.

It will thus be seen that the objects set forth above, including those made apparent from the preceding description, are efficiently attained. Since certain changes may be made in designing the described structures when placing such structures into mass production, it is to be understood that my invention may be embodied in other specific forms without departing from the spirit or essential characteristics thereof. Many other embodiments are also feasible to attain advantageous results utilizing the principles disclosed herein. Therefore, it will be understood that the foregoing description of representative embodiments of the invention have been presented only for purposes of illustration and for providing an understanding of the invention, and it is not intended to be exhaustive or restrictive, or to limit the invention only to the precise embodiments disclosed. The intention is to cover all modifications, equivalents, and alternatives falling within the scope and spirit of the invention, as expressed herein above and in the appended claims. As such, the claims are intended to cover the methods, apparatus, structures, and not only the equivalent methods or structural equivalents thereof, but also equivalent methods or structures. The scope of the invention, as described herein is thus intended to include variations from the embodiments provided which are nevertheless described by the broad meaning and range properly afforded to the language herein, as explained by and in light of the terms included herein, or the equivalents thereof.

What is claimed is:

1. A beverage container comprising:

(a) a bottom wall;

(b) a top wall, said top wall further comprising a manually openable liquid outlet;

(c) a substantially cylindrical sidewall, said sidewall extending between said bottom wall and said top wall, said substantially cylindrical sidewall further comprising, near said liquid outlet, a generally nose-shaped inward indentation.

2. The beverage container as set forth in claim 1, wherein said generally nose-shaped inward indentation has a transverse cross-sectional profile of reducing area as such profile is examined progressively toward said liquid outlet.

3. The beverage container as set forth in claim 1, wherein said liquid outlet has a centerline $C_L$ and an edge line $E_L$ which are spaced apart by an angle alpha ($\alpha$), and wherein said generally nose-shaped indentation structure has a centerline $C_s$, and wherein said centerline $C_s$ is located substantially at said centerline $C_L$.

4. The beverage container as set forth in claim 1, wherein said generally nose-shaped indentation comprises a section of an oblique circular cone.

5. The beverage container as set forth in claim 1, wherein said generally nose-shaped indentation comprises an arrowhead shaped indentation.

6. The beverage container as set forth in claim 1, wherein said generally nose-shaped inward indentation is oriented for receiving a thumb of a drinker using the container, and where fingers of said drinker can grip said substantially cylindrical sidewalls, so that said drinker can orient said liquid outlet of said container by tactile sense alone.

7. The beverage container as set forth in claim 1, wherein said substantially cylindrical sidewall comprises only inward protruding indentations, so that said container is rollable along a flat or sloping surface or track.

8. The beverage container as set forth in claim 1, wherein said container comprises a can.

9. The beverage container as set forth in claim 8, wherein said can comprises aluminum.

10. The beverage container as set forth in claim 1, wherein said liquid outlet has a centerline $C_L$ and an edge line $E_L$ which are spaced apart by an angle alpha ($\alpha$), and wherein said generally nose-shaped indentation structure has a centerline $C_s$, and wherein said centerline $C_s$ is offset clockwise from said centerline $C_L$ by an angle sigma ($\Sigma$).

11. The beverage container as set forth in claim 10, wherein said angle sigma ($\Sigma$) is at least one-third of said angle alpha ($\alpha$).

12. The beverage container as set forth in claim 10, wherein said angle sigma ($\Sigma$) is at least as large as said angle alpha ($\alpha$).

13. The beverage container as set forth in claim 1, wherein said liquid outlet has a centerline $C_L$ and an edge line $E_L$ which are spaced apart by an angle alpha ($\alpha$), and wherein said generally nose-shaped indentation structure has a centerline $C_s$, and wherein said centerline $C_s$ is offset counterclockwise from said centerline $C_L$ by an angle omega ($\Omega$).

14. The beverage container as set forth in claim 13, wherein said angle omega ($\Omega$) is at least one-third of said angle alpha ($\alpha$).

15. The beverage container as set forth in claim 13, wherein said angle omega ($\Omega$) is at least as large as said angle alpha ($\alpha$).

16. The beverage container as set forth in claim 1, wherein said generally nose-shaped inward indentation is substantially pyramid shaped.

17. The beverage container as set forth in claim 16, wherein said substantially pyramid shaped inward indentation comprises a pyramid of inward height H.

18. The beverage container as set forth in claim 17, wherein said substantially pyramidal shape further comprises a generally planar triangular base.

19. The beverage container as set forth in claim 17, wherein said substantially pyramidal shape further comprises opposing inward triangular panels, said opposing inward triangular panels having a common ridge line, and each of said opposing inward triangular panels having an edge adjoining said substantially cylindrical sidewall.

20. An aluminum beverage can, said can comprising:

(a) a bottom wall;

(b) a top wall, said top wall further comprising a liquid outlet;

(c) a substantially cylindrical sidewall, said substantially cylindrical sidewall sealingly affixed to, and extending between, said bottom wall and said top wall, said substantially cylindrical sidewall further comprising, near said liquid outlet, a generally nose-shaped inward indentation, and wherein said generally nose-shaped inward indentation has a transverse cross-sectional profile of reducing area as such profile is examined progressively toward said liquid outlet.

* * * * *